US008441412B2

(12) United States Patent
Cummings

(10) Patent No.: US 8,441,412 B2
(45) Date of Patent: May 14, 2013

(54) MODE INDICATOR FOR INTERFEROMETRIC MODULATOR DISPLAYS

(75) Inventor: William Cummings, Millbrae, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 164 days.

(21) Appl. No.: 13/014,033

(22) Filed: Jan. 26, 2011

(65) Prior Publication Data

US 2011/0115690 A1 May 19, 2011

Related U.S. Application Data

(63) Continuation of application No. 11/405,116, filed on Apr. 17, 2006, now Pat. No. 7,903,047.

(51) Int. Cl.
*G09G 5/00* (2006.01)

(52) U.S. Cl.
USPC ..... 345/3.1

(58) Field of Classification Search ..... 345/1.1, 345/2.1, 3.1
See application file for complete search history.

(56) References Cited

U.S. PATENT DOCUMENTS

| | | | |
|---|---|---|---|
| 4,441,791 | A | 4/1984 | Hornbeck |
| 4,571,603 | A | 2/1986 | Hornbeck et al. |
| 4,748,366 | A | 5/1988 | Taylor |
| 4,859,060 | A | 8/1989 | Katagiri et al. |
| 4,954,789 | A | 9/1990 | Sampsell |
| 5,083,857 | A | 1/1992 | Hornbeck |
| 5,216,537 | A | 6/1993 | Hornbeck |
| 5,226,099 | A | 7/1993 | Mignardi et al. |
| 5,489,952 | A | 2/1996 | Gove et al. |
| 5,526,172 | A | 6/1996 | Kanack |
| 5,530,240 | A | 6/1996 | Larson et al. |
| 5,550,373 | A | 8/1996 | Cole et al. |
| 5,551,293 | A | 9/1996 | Boysel et al. |
| 5,629,521 | A | 5/1997 | Lee et al. |
| 5,686,934 | A | 11/1997 | Nonoshita et al. |
| 5,815,135 | A | 9/1998 | Yui et al. |

(Continued)

FOREIGN PATENT DOCUMENTS

| | | |
|---|---|---|
| EP | 0 450 640 | 10/1991 |
| EP | 0 649 010 | 4/1995 |

(Continued)

OTHER PUBLICATIONS

Office Action dated Jun. 22, 2011 in Chinese App. No. 200780013433.9.

(Continued)

*Primary Examiner* — Kevin M Nguyen
(74) *Attorney, Agent, or Firm* — Knobbe Martens Olson & Bear LLP

(57) ABSTRACT

A method and apparatus for displaying data on bi-stable and non-bi-stable displays is provided. The apparatus includes a controller chip capable of being connected to a non-bi-stable display through a first interface channel and also capable of being connected to a bi-stable display via the first interface channel and an additional second interface channel. When connected the non-bi-stable display, the second interface channel is not connected. The second interface channel may carry mode information bits to the bi-stable display module to allow the bi-stable display to utilize power-saving features.

18 Claims, 14 Drawing Sheets

800

| THREE-BIT/WIRE DISPLAY MODE INDICATOR | | |
|---|---|---|
| BIT VALUE | DISPLAY MODE | ACTION |
| 000 | DISPLAY DATA UNCHANGED | IGNORE IMAGE DATA |
| 001 | FULL FRAME UPDATE | ACCEPT ALL IMAGE DATA |
| 010 | HIGH BIT DEPTH | TURN ON TEMPORAL DITHERING INCREASE FRAME RATE |
| 011 | LOW BIT DEPTH | TURN OFF TEMPORAL DITHERING |
| 100 | CHARGE BALANCE UPDATE NECESSARY | EXECUTE CHARGE BALANCE SEQUENCE |
| 101 | LOW POWER | LOWER REFRESH RATE IGNORE SOME FRAMES |
| 110 | PARTIAL FRAME UPDATE | UPDATE ROWS UNTIL NEW MODE BIT RECEIVED |
| 111 | NO MODE/ERROR | NONE |

802 804 806 808 810 812 814 816

U.S. PATENT DOCUMENTS

| | | | | |
|---|---|---|---|---|
| 5,815,141 | A | 9/1998 | Phares | |
| 5,894,686 | A | 4/1999 | Parker et al. | |
| 5,953,074 | A | 9/1999 | Reddy | |
| 5,977,945 | A | 11/1999 | Ohshima | |
| 6,014,121 | A | 1/2000 | Aratani et al. | |
| 6,040,937 | A | 3/2000 | Miles | |
| 6,043,798 | A | 3/2000 | Yamamoto et al. | |
| 6,295,048 | B1 | 9/2001 | Ward et al. | |
| 6,304,297 | B1 | 10/2001 | Swan | |
| 6,307,194 | B1 | 10/2001 | Fitzgibbons et al. | |
| 6,525,723 | B1 | 2/2003 | Deering | |
| 6,666,561 | B1 | 12/2003 | Blakley | |
| 6,674,562 | B1 | 1/2004 | Miles | |
| 6,737,979 | B1 | 5/2004 | Smith et al. | |
| 6,819,469 | B1 | 11/2004 | Koba | |
| 6,829,132 | B2 | 12/2004 | Martin et al. | |
| 6,982,722 | B1 | 1/2006 | Alben et al. | |
| 7,123,216 | B1 | 10/2006 | Miles | |
| 7,129,909 | B1 * | 10/2006 | Dong et al. | 345/1.1 |
| 7,138,984 | B1 | 11/2006 | Miles | |
| 7,280,265 | B2 | 10/2007 | Miles | |
| 7,327,510 | B2 | 2/2008 | Cummings et al. | |
| 7,369,294 | B2 | 5/2008 | Gally et al. | |
| 7,446,785 | B1 | 11/2008 | Hewlett et al. | |
| 7,460,246 | B2 | 12/2008 | Kothari | |
| 7,535,466 | B2 | 5/2009 | Sampsell et al. | |
| 7,586,484 | B2 | 9/2009 | Sampsell et al. | |
| 7,653,371 | B2 | 1/2010 | Floyd | |
| 7,657,242 | B2 | 2/2010 | Floyd | |
| 7,808,703 | B2 | 10/2010 | Gally et al. | |
| 7,852,483 | B2 | 12/2010 | Kothari | |
| 7,881,686 | B2 | 2/2011 | Floyd | |
| 7,903,047 | B2 | 3/2011 | Cummings | |
| 7,920,135 | B2 | 4/2011 | Sampsell et al. | |
| 7,929,196 | B2 | 4/2011 | Gally et al. | |
| 2002/0075555 | A1 | 6/2002 | Miles | |
| 2003/0043157 | A1 | 3/2003 | Miles | |
| 2003/0112507 | A1 | 6/2003 | Divelbiss et al. | |
| 2003/0117382 | A1 | 6/2003 | Pawlowski et al. | |
| 2003/0122773 | A1 | 7/2003 | Washio et al. | |
| 2003/0128197 | A1 | 7/2003 | Turner et al. | |
| 2004/0024580 | A1 | 2/2004 | Salmonsen et al. | |
| 2004/0142720 | A1 | 7/2004 | Smethers | |
| 2005/0001797 | A1 | 1/2005 | Miller et al. | |
| 2005/0068254 | A1 | 3/2005 | Booth | |
| 2005/0206634 | A1 | 9/2005 | Hamamoto et al. | |
| 2006/0066504 | A1 * | 3/2006 | Sampsell et al. | 345/1.1 |
| 2006/0066596 | A1 | 3/2006 | Sampsell et al. | |
| 2006/0176241 | A1 | 8/2006 | Sampsell | |
| 2007/0023851 | A1 | 2/2007 | Hartzell et al. | |
| 2007/0200839 | A1 | 8/2007 | Sampsell | |
| 2007/0247406 | A1 | 10/2007 | Zhou et al. | |
| 2008/0112031 | A1 | 5/2008 | Gally et al. | |
| 2009/0267869 | A1 | 10/2009 | Gally et al. | |
| 2009/0267953 | A1 | 10/2009 | Sampsell et al. | |
| 2010/0117761 | A1 | 5/2010 | Floyd | |
| 2010/0123706 | A1 | 5/2010 | Lan | |
| 2010/0220248 | A1 | 9/2010 | Miles | |
| 2011/0085278 | A1 | 4/2011 | Floyd | |
| 2011/0148828 | A1 | 6/2011 | Sampsell et al. | |

FOREIGN PATENT DOCUMENTS

| | | |
|---|---|---|
| EP | 0 725 380 | 8/1996 |
| WO | WO 2004/066256 | 8/2004 |
| WO | WO 2005/066596 | 7/2005 |

OTHER PUBLICATIONS

Brank et al., Sep. 2001, RF MEMS-based tunable filters, International Journal of RF and Microwave Computer-Aided Engineering, 11(5):276-284.

Miles, A New Reflective FPD Technology Using Interferometric Modulation, Journal of the SID 5/4, 1997, pp. 379-382.

Miles, "MEMS-based interferometric modulator for display applications," Proceedings of SPIE, vol. 3876, Aug. 1999, pp. 20-281.

Miles et al., 10.1: Digital Paper™ for reflective displays, SID 02 Digest, pp. 115-117, 2002.

Winton, John M., A novel way to capture solar energy, Chemical Week, pp. 17-18 (May 15, 1985).

Wu, Design of a Reflective Color LCD Using Optical Interference Reflectors, ASIA Display '95, pp. 929-931 (Oct. 16, 1995).

ISR and WO for PCT/US07/008773, filed Apr. 11, 2007.

IPRP for PCT/US07/008773, filed Apr. 11, 2007.

Official Communication dated Sep. 21, 2010 in European App. No. 07755145.5.

Office Action dated Mar. 12, 2009 in U.S. Appl. No. 11/405,116.

Office Action dated Jun. 19, 2009 in U.S. Appl. No. 11/405,116.

Office Action dated Oct. 29, 2009 in U.S. Appl. No. 11/405,116.

Office Action dated May 10, 2010 in U.S. Appl. No. 11/405,116.

Summons to Attend Oral Proceedings dated Sep. 25, 2012 in European App. No. 07755145.5.

* cited by examiner

| | | Column Output Signals | |
|---|---|---|---|
| | | + $V_{bias}$ | $-V_{bias}$ |
| Row Output Signals | 0 | Stable | Stable |
| | + ΔV | Relax | Actuate |
| | −ΔV | Actuate | Relax |

800

| THREE-BIT/WIRE DISPLAY MODE INDICATOR | | |
|---|---|---|
| BIT VALUE | DISPLAY MODE | ACTION |
| 000 | DISPLAY DATA UNCHANGED | IGNORE IMAGE DATA |
| 001 | FULL FRAME UPDATE | ACCEPT ALL IMAGE DATA |
| 010 | HIGH BIT DEPTH | TURN ON TEMPORAL DITHERING INCREASE FRAME RATE |
| 011 | LOW BIT DEPTH | TURN OFF TEMPORAL DITHERING |
| 100 | CHARGE BALANCE UPDATE NECESSARY | EXECUTE CHARGE BALANCE SEQUENCE |
| 101 | LOW POWER | LOWER REFRESH RATE IGNORE SOME FRAMES |
| 110 | PARTIAL FRAME UPDATE | UPDATE ROWS UNTIL NEW MODE BIT RECEIVED |
| 111 | NO MODE/ERROR | NONE |

802 804 806 808 810 812 814 816

*FIG. 8*

MODE INDICATOR FOR INTERFEROMETRIC MODULATOR DISPLAYS

CROSS-REFERENCE TO RELATED APPLICATIONS

This application is a continuation of U.S. patent application Ser. No. 11/405,116, filed on Apr. 17, 2006, the entirety of which is hereby incorporated by reference herein.

BACKGROUND OF THE INVENTION

Microelectromechanical systems (MEMS) include micro mechanical elements, actuators, and electronics. Micromechanical elements may be created using deposition, etching, and or other micromachining processes that etch away parts of substrates and/or deposit material layers or that add layers to form electrical and electromechanical devices. One type of MEMS device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY OF THE INVENTION

In a first embodiment a controller in a display device is provided. The controller includes a first data output stream which has data usable by a display module of a first display type and a display module of a second display type to write an image. The controller also includes a second data output stream which has data configured to control an additional feature of the display module of the second display type.

In another embodiment, a video display interface apparatus is provided. The apparatus includes a controller configured to process image data and display mode data. The system also may include an array driver configured to receive the processed image data and the display mode data from the controller. The array driver may also be configured to act or not act upon the image data based on the display mode. The system also includes a bi-stable display array having an array of display elements in electrical communication with the array driver.

In another embodiment, a method for maintaining a display image in a MEMS display module is provided. The method comprises receiving image data for processing by a processor. Based on the received image data, a display mode is determined and the image data is sent along with the display mode to a driver controller. The method further provides for sending the image data from the display driver to the display module over a first signal path in a bus and sending data indicating the display mode to the display module over a second signal path in a bus. Based on the display mode, a determination is made as to whether to update the display image.

In another embodiment, a method for manufacturing and deploying a driver controller compatible with a non-bi-stable conventional display and a bi-stable display is provided. The method comprises providing a driver controller with a display interface. The display interface comprises one or more wires and being operably connectable to the non-bi-stable display. The method further may include adding at least one additional wire to the display interface. The at least one additional wire may be operably connectable to the bi-stable display.

In yet another embodiment, a system for displaying video data comprises a processor configured to receive image data and a driver controller configured to receive the image data from the processor. The system may also include an array driver configured to receive the image data from the driver controller and a display array configured to receive the data from said array driver. The driver controller may be further configured to, upon receiving image data from the processor, determine a display mode of the display array. The driver controller may also send data to the array driver indicating the display mode for the received image data via at least one mode signal path in a bus.

BRIEF DESCRIPTION OF THE DRAWINGS

FIG. 8 is an example of a mode indicator bit scheme.

DETAILED DESCRIPTION OF THE PREFERRED EMBODIMENT

The following detailed description is directed to certain specific embodiments of the invention. However, the invention can be embodied in a multitude of different ways. In this description, reference is made to the drawings wherein like parts are designated with like numerals throughout. As will be apparent from the following description, the embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Currently, in many display devices, driver controllers are configured to send constant frame updates to the display. These configurations do not take advantage of power-saving features in MEMS devices because the display is updated with the new frame data regardless of whether the data has changed since the previous frame. By placing additional data in the form of mode bits in the output of the driver controller, a display module can take advantage of power-saving features of the display by indicating a display mode which allows the display module to determine how to handle a frame of image data received from the driver controller. Display modes may be defined such that the display controller sends image data to a display module only if the image data in the current frame differs from the previous sent frame. Other display modes may be defined such that an array driver does not address a portion of a display array if it receives mode data that indicates that the image data is changed only in a defined segment from the previous frame.

Figure 1:
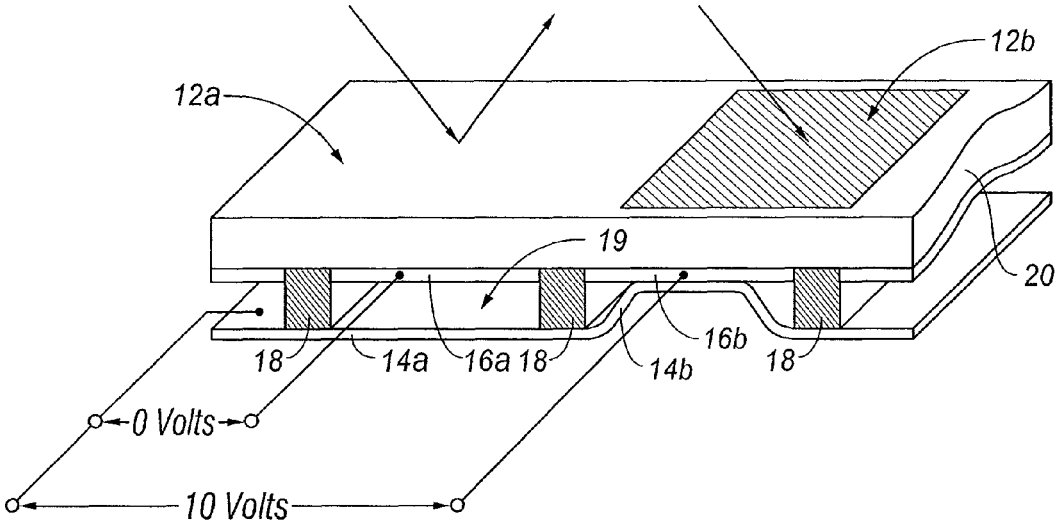
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise of several fused layers, which can include an electrode layer, such as indium tin oxide (ITO), a partially reflective layer, such as chromium, and a transparent dielectric. The optical stack 16 is thus electrically conductive, partially transparent and partially reflective, and may be fabricated, for example, by depositing one or more of the above layers onto a transparent substrate 20. The partially reflective layer can be formed from a variety of materials that are partially reflective such as various metals, semiconductors, and dielectrics. The partially reflective layer can be formed of one or more layers of materials, and each of the layers can be formed of a single material or a combination of materials.

In some embodiments, the layers of the optical stack are patterned into parallel strips, and may form row electrodes in a display device as described further below. The movable reflective layers 14*a*, 14*b* may be formed as a series of parallel strips of a deposited metal layer or layers (orthogonal to the row electrodes of 16*a*, 16*b*) deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form column electrodes in a display device.

With no applied voltage, the cavity 19 remains between the movable reflective layer 14*a* and optical stack 16*a*, with the movable reflective layer 14*a* in a mechanically relaxed state, as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

FIGS. 2 through 5B illustrate one exemplary process and system for using an array of interferometric modulators in a display application.

Figure 2:
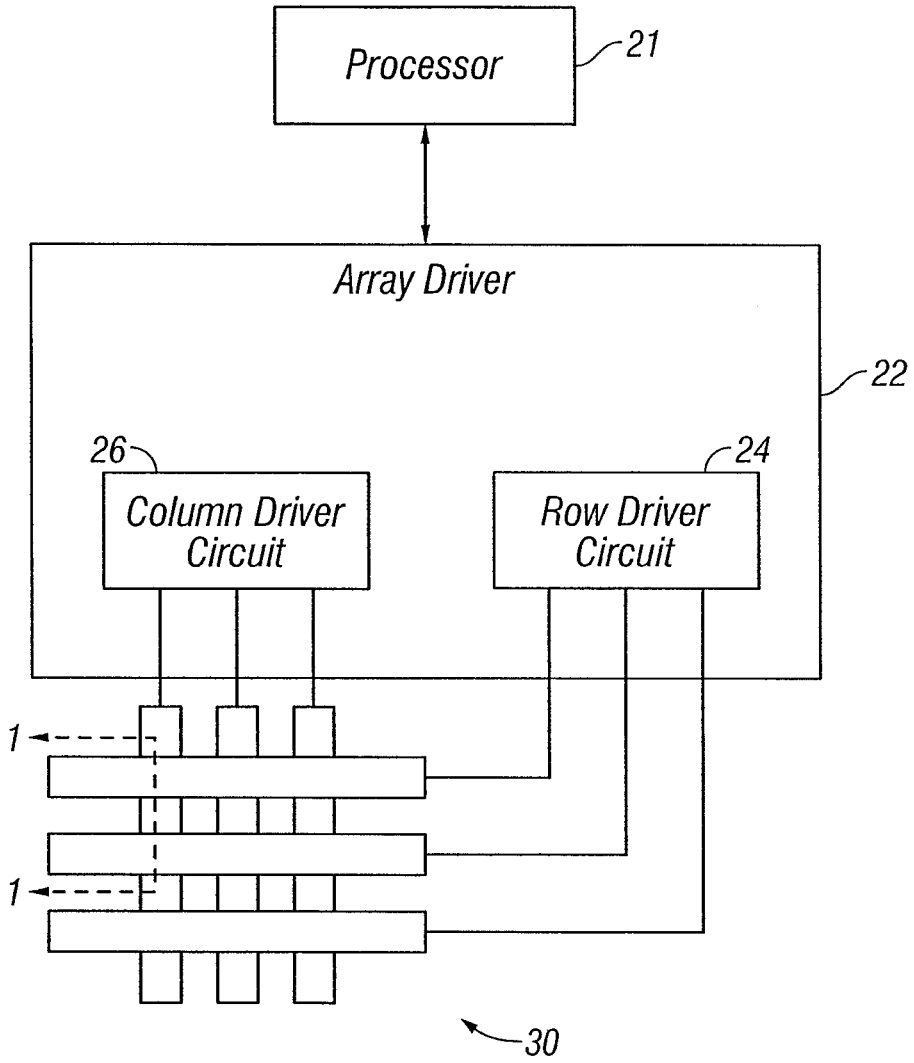
FIG. 2 is a system block diagram illustrating one embodiment of an electronic device incorporating a 3×3 interferometric modulator display.

FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a display array or panel 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the relaxed state to the actuated state. However, when the voltage is reduced from that value, the movable layer maintains its state as the voltage drops back below 10 volts. In the exemplary embodiment of FIG. 3, the movable layer does not relax completely until the voltage drops below 2 volts. There is thus a range of voltage, about 3 to 7 V in the example illustrated in FIG. 3, where there exists a window of applied voltage within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
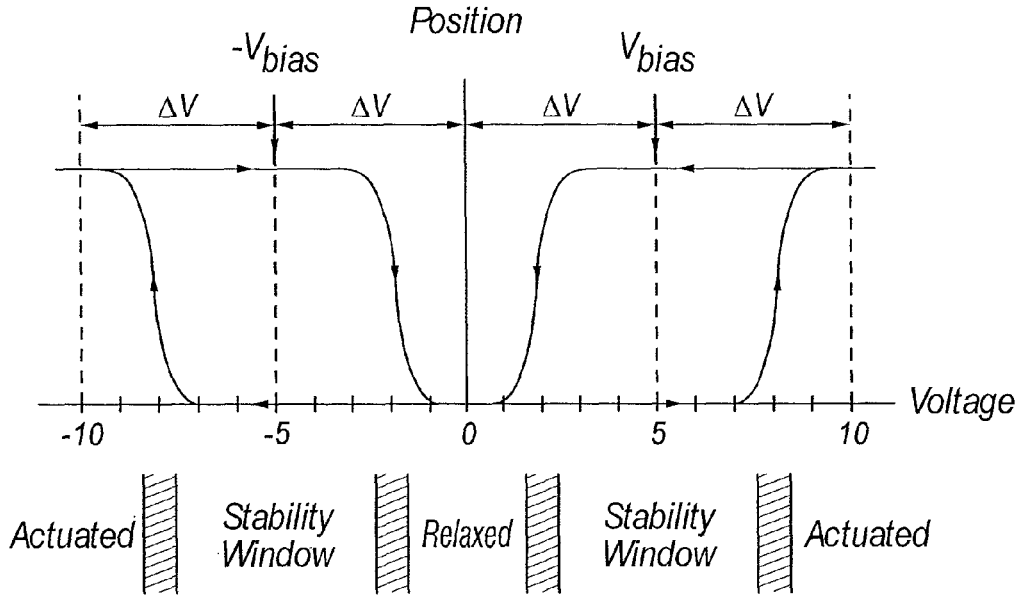
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.
Figure 5A:
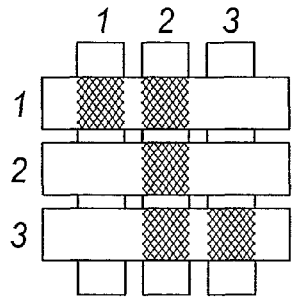
FIG. 5A illustrates one exemplary frame of display data in the 3×3 interferometric modulator display of FIG. 2.
Figure 5B:
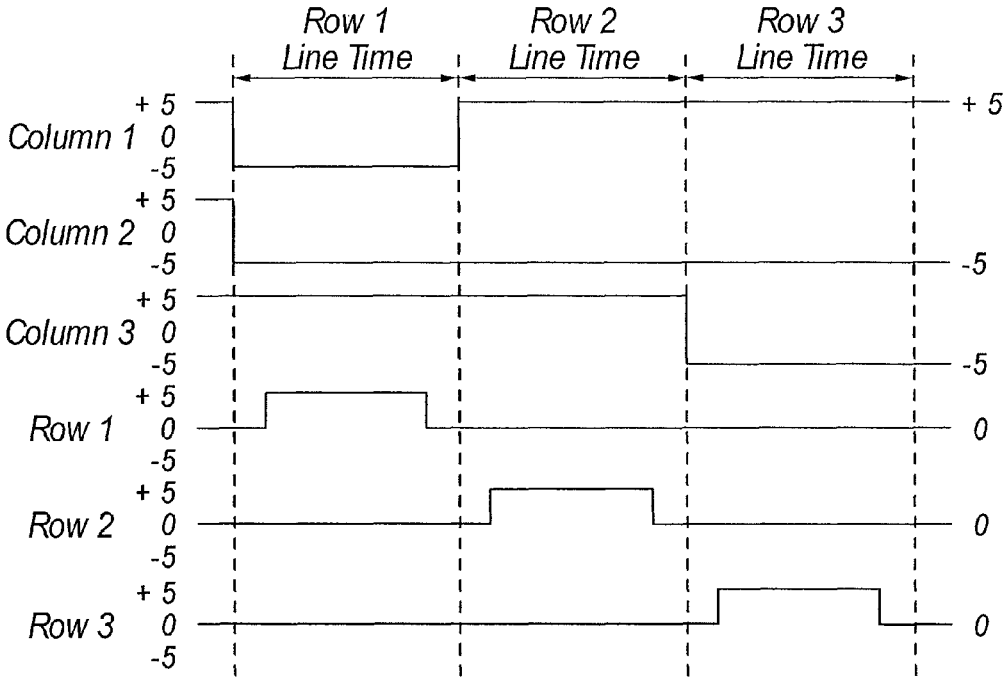
FIG. 5B illustrates one exemplary timing diagram for row and column signals that may be used to write the frame of FIG. 5A.

FIGS. 4, 5A, and 5B illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and relaxes the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and relax pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the systems and methods described herein.

Figure 6A:
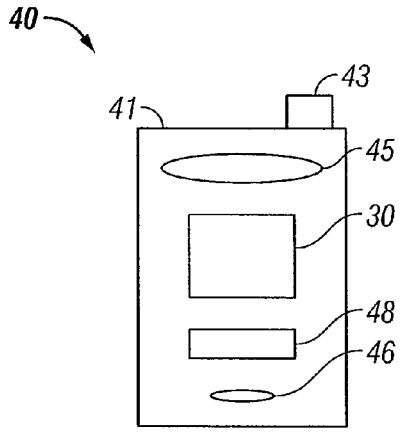
FIGS. 6A and 6B are system block diagrams illustrating an embodiment of a visual display device comprising a plurality of interferometric modulators.
Figure 6B:
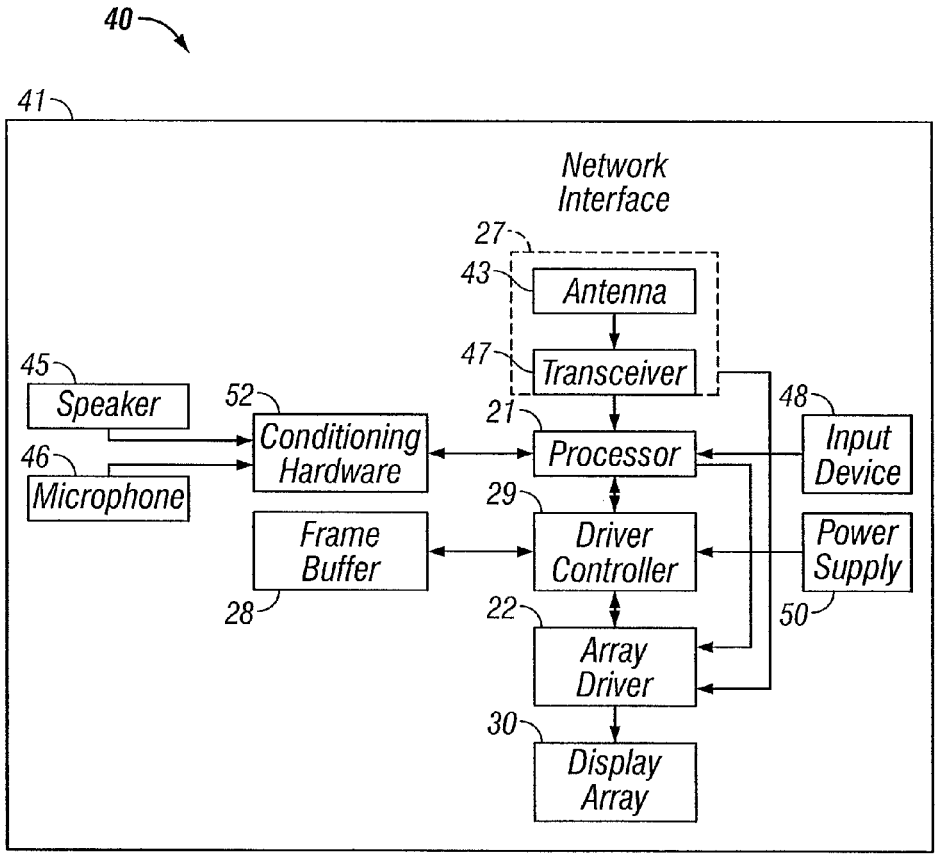

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one ore more devices over a network. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations control programmability resides, as described above, in a driver controller which can be located in several places in the electronic display system. In some cases control programmability resides in the array driver 22. Those of skill in the art will recognize that the above-described optimization may be implemented in any number of hardware and/or software components and in various configurations.

Figure 7A:
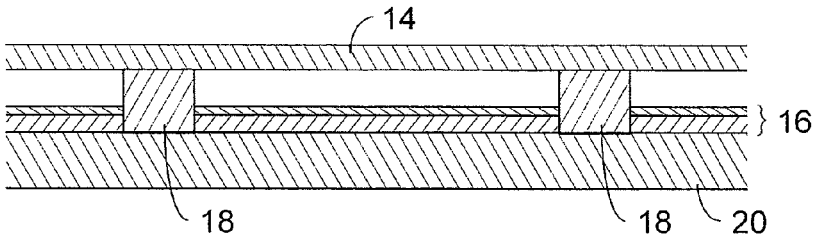
FIG. 7A is a cross section of the device of FIG. 1.
Figure 7B:
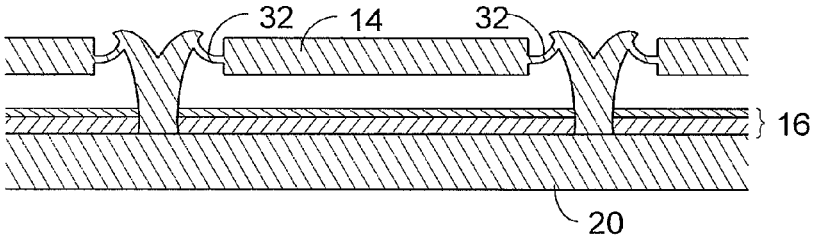
FIG. 7B is a cross section of an alternative embodiment of an interferometric modulator.
Figure 7C:
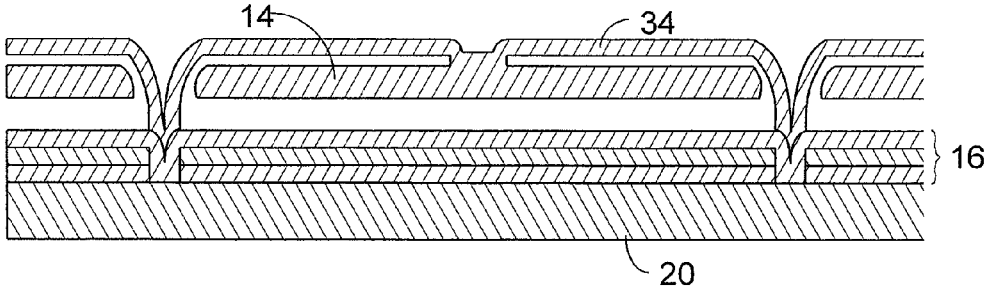
FIG. 7C is a cross section of another alternative embodiment of an interferometric modulator.
Figure 7D:
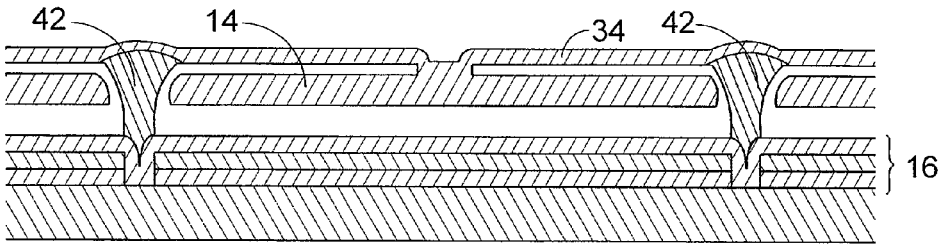
FIG. 7D is a cross section of yet another alternative embodiment of an interferometric modulator.
Figure 7E:
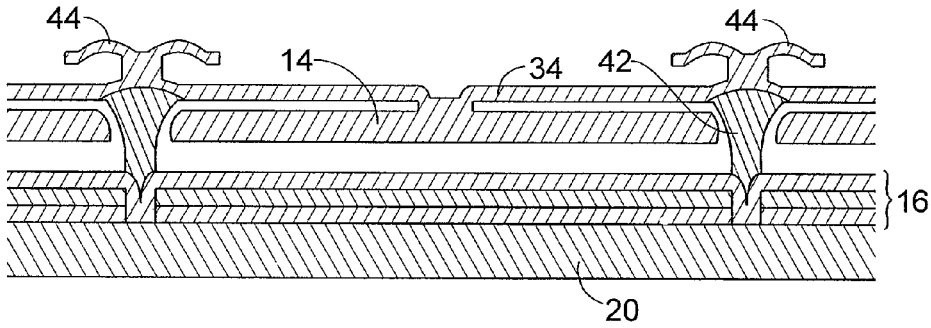
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 is attached to supports at the corners only, on tethers 32. In FIG. 7C, the moveable reflective layer 14 is suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the cavity, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields the portions of the interferometric modulator on the side of the reflective layer opposite the substrate 20, including the deformable layer 34. This allows the shielded areas to be configured and operated upon without negatively affecting the image quality. Such shielding allows the bus structure 44 in FIG. 7E, which provides the ability to separate the optical properties of the modulator from the electromechanical properties of the modulator, such as addressing and the movements that result from that addressing. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

Bi-stable displays devices, which are one type of a MEMS display devices such as those described herein, may include a power saving feature in which the display need not be updated if the display data has not changed. However, video controllers that are currently known in the art are designed to send constant data updates to the display because non-bi-stable display devices require constant refresh in order to remain illuminated. Thus, known video controllers that send constant data streams when connected to bi-stable displays may cause unnecessary updates of the display to occur, which will tend to hinder the power saving features of the display.

One approach to avoiding unnecessary updates of the display has been to use a frame buffer to compare the current frame of image data to the next frame of image data (or the current line of data to the same line of data in the next frame). However, such comparisons may be computationally expensive, and the power savings achieved by performing frame buffer comparisons may ultimately become minimal. In an embodiment of the invention, this computationally expensive use of a frame buffer may be avoided by placing additional bits in the output of either the system processor 21 or the driver controller 29 to indicate the mode of the display data. The processor 21 may be configured to apply a set of rules by which it can determine how and whether a new frame or line of image data is different from a current frame or line of image data to be written to the display as will be discussed in more detail below. By determining or predicting the content of new image data as it relates to current image data, the processor may send mode information in parallel with the image data that allows the array driver 22 to ignore the new image data if it does not require an update of the display.

In one embodiment, a display array 30 such as that found in FIG. 6B, includes an array of interferometric modulators configured to be driven by an array driver. After system processor 21 sends the image data to driver controller 29, additional data may be generated and are placed in the data output stream of driver controller 29 which indicate a display mode for the display data. The display mode provides information that tells array driver 22 how to handle or act on the image data in a manner discussed in more detail below. The mode data may be in the form of bits or control signals that supplement the normal digital output of driver controller 29. The mode bits may be carried serially along with the display data across a serial bus, or additional wires may be provided in a parallel bus interface to carry the additional mode output from driver controller.

In an embodiment, a display module that may include array driver 22 and display array 30 is configured to handle the mode data and respond according to the display mode indicated by mode data received by the display module. Mode data may be sent with various sizes of blocks of image data. In one embodiment, mode data may be sent with each new frame of image data, indicating a display mode for the entire frame of data. Alternatively, mode data may be sent with each row/line of data that is sent to the array driver, providing information for each particular row in the frame.

Referring to FIG. 8, a mode definition table 800 is provided which provides an example of a 3-bit mode bit scheme that may be implemented with a bi-stable display device 40 such as the one shown in FIG. 6B. Although the display modes described herein are generally implemented through array driver 22 responding according to a received display mode by altering its output to the display, one of skill in the art will appreciate that in other embodiments, driver controller 29 could be configured to handle display mode data by altering its output to array driver 22. Moreover, in yet other embodiments, system processor 21 may be configured to both create the mode data and handle or process the mode data by altering the image data sent to driver controller based on the display mode.

At row 802, the mode bit(s) indicate a first display mode in which the image data is unchanged from the previous frame. In that instance, the display mode will indicate to the display module, which as noted above may include array driver 22 or display array 30, not to act upon the data because the data is unchanged. Array driver 22, having received the mode data along with a frame of image data, does not act on the image data, i.e., array driver 22 will not address display array 30 with the received image data. In this manner, the display is not addressed with new image data, but instead receives no charge from the array driver, thereby allowing it to take advantage of the power-saving hysteresis properties of bi-stable display array 30.

At row 804, a second mode is defined for a total frame update display mode that indicates that the new frame of data includes image data that is different than the currently displayed frame. In this mode, array driver 22 refreshes display array 30 with the image data received from processor 21 and controller 29.

In row 806, another display mode is defined that provides for enhanced control over display settings where the bit-depth of the data varies. Certain display devices are capable of displaying images at varying bit-depths. For example, a clock image on a display might be displayed at a low bit-depth because the level of detail necessary to properly display the clock image is relatively low. The same display device may also be capable of displaying images such as video data, which are best viewed at a high bit-depth. In some instances, in order to achieve a high bit-depth visual effect, bi-stable display 30 will flicker or dither certain pixels to get a gray-scale effect. When high bit-depth data is sent to the display, the mode data may indicate a display mode in which display array 30 should turn on temporal dithering to achieve a full-color depth effect for the video images displayed on the display array 30. Similarly, when low bit-depth data is sent to the display, an additional mode may be defined such that temporal dithering is turned off, as provided in row 808.

Although bi-stable displays such as display 30 may take advantage of hysteresis properties that allow them to generally avoid refreshing the display if the display data has not changed, there are instances where an update may be desired even if the display data remains the same. For example, it may be necessary at times to correct the charge balance of the display by periodically reversing the polarity of the MEMS display elements. At row 810, a display mode is defined that indicates to array driver 22 that an update for charge balance is necessary.

At row 812, an additional display mode is defined, for example, in order to handle situations where a low battery signal has been received from the system processor 21 or from some other component in display device 40. This low-battery display mode causes array driver 22 to send data updates to the display at a reduced rate, even if there is changed data to display, in order to conserve system resources.

At row 814, a partial frame update mode is defined that will be discussed in greater detail below in connection with FIG. 10. Partial frame update mode 814 instructs array driver 22 to address only certain rows in the display because only those rows have received new image data.

In some embodiments, system processor 22 and driver controller 29 may receive image data, but for some reason may not able to determine a display mode for the data. In other embodiments, the display mode data may not be transmitted to the display module due to some error in programming logic or for some other reason. To properly handle these error situations, an exception handling mode is defined which handles situations where no display mode is included with image data that has been received by the driver controller 29 or array driver 22. Typically, this mode will simply update the entire display with the received frame of image data.

In order for display mode information to be included in the output of the video controller, the display device 40 must first determine a display mode that corresponds to the image data that will be displayed. Current solutions for preventing unnecessary updates of bi-stable displays rely on computationally expensive frame buffer comparisons. In an embodiment, display device 40 may be configured to determine a display mode for a bi-stable display without relying exclusively on a computationally expensive frame buffer comparison, or in alternative embodiments, without the use of a frame buffer comparison at all.

System processor 22 may be configured to determine a display mode based on system events that occur at regular intervals. By way of example and not of limitation, total frame update display mode data 804 may be included in display data which is created to reflect clock update events which occur at regular intervals. In display device 40, driver controller 29 may provide data for driving display array 30 to the array driver 22 at a specified "refresh rate." Because display device 40 may include a bi-stable display, it may not be necessary to refresh the display when the image data has not changed.

In a typical usage scenario for display device 40, the displayed image may not change from frame to frame. Thus, in many instances, the display mode will indicate that the display image data has not changed, and that array driver 22 need not address display array 30 with the display image data, because the display does not need to change. Because certain types of system events typically require updates to the display, the knowledge that certain of these system events occur at regular intervals may be utilized to determine a display mode for a frame of image data created by the system event.

Figure 9A:
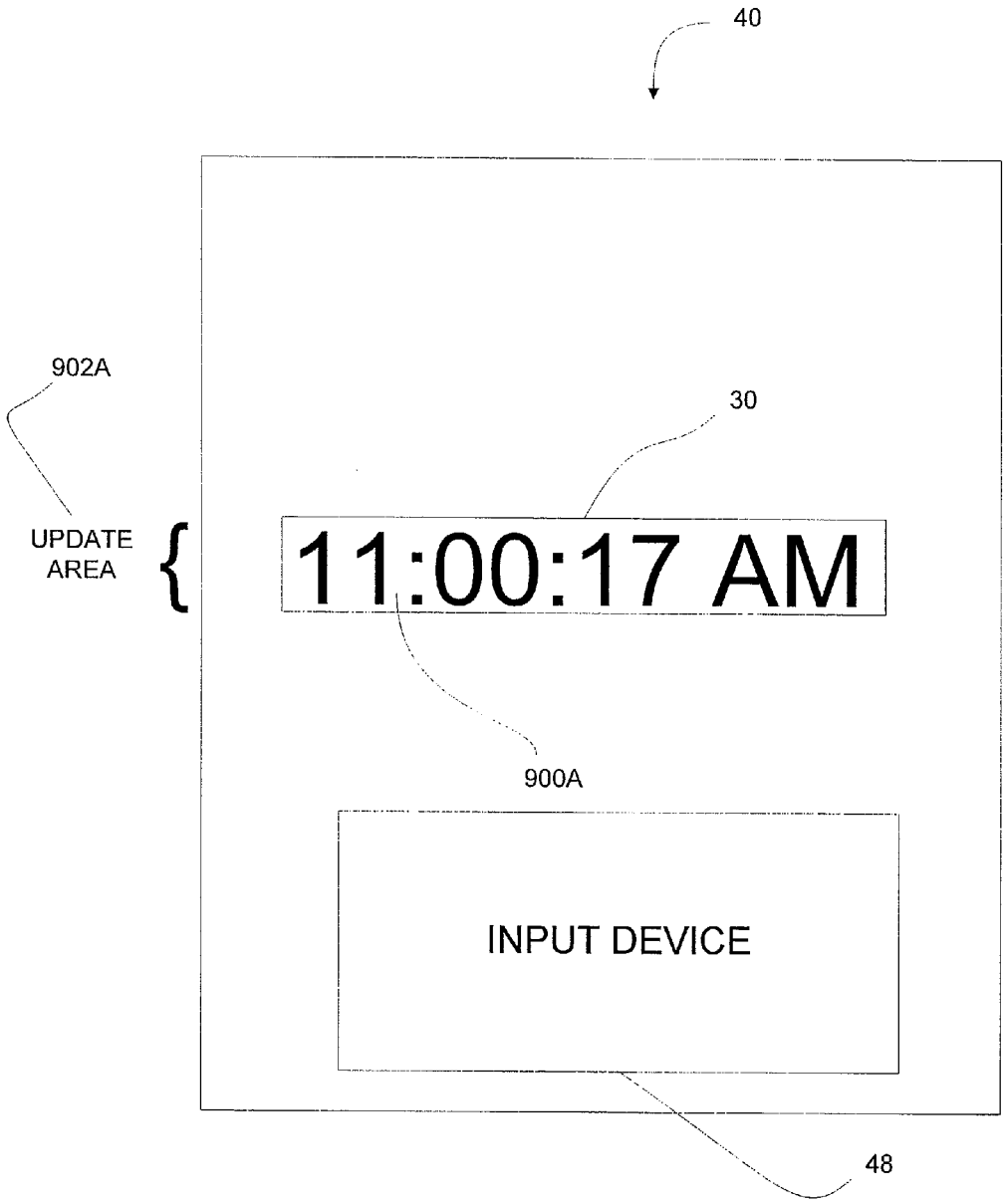
FIG. 9 provides an exemplary display devices with a clock displays in accordance with one or more embodiments.

Referring now to FIG. 9A, another view of an exemplary display device 40 is provided which implements total frame update data mode 804, which was described above in connection with FIG. 8. Display device 40 includes display array 30, which includes a clock display 900A, that displays the time of day to the user of the display device in the form HH:MM:SS (hours, minutes, and seconds). As discussed above, one of skill in the art will readily appreciate that various electronic devices may display time in a substantially similar manner. By way of example and not of limitation, display device 40 may have a refresh rate of 30 Hz that is maintained by either driver controller 29 (not shown), array driver 22, or system processor 21 (not shown), which provides a frame of data to display array 30 at a rate of 30 frames per second. Thus, in a display device 40 in which the display array 30 provides clock display 900A, every thirtieth frame of display data includes changed display data which is provided to update the displayed second on the display. Driver controller 29 and/or system processor 21 (not shown) can be configured to account for this regularly occurring system event such that with every thirtieth frame, the display mode may be set to update the display 30 with new data. In this exemplary embodiment, because the clock display 900A covers substantially all of display array 30, total frame update mode 804 is indicated and transmitted from either system controller 21 or driver controller 29 to the display module. As a result, update area 902A includes substantially all of display array 30.

Figure 9B:
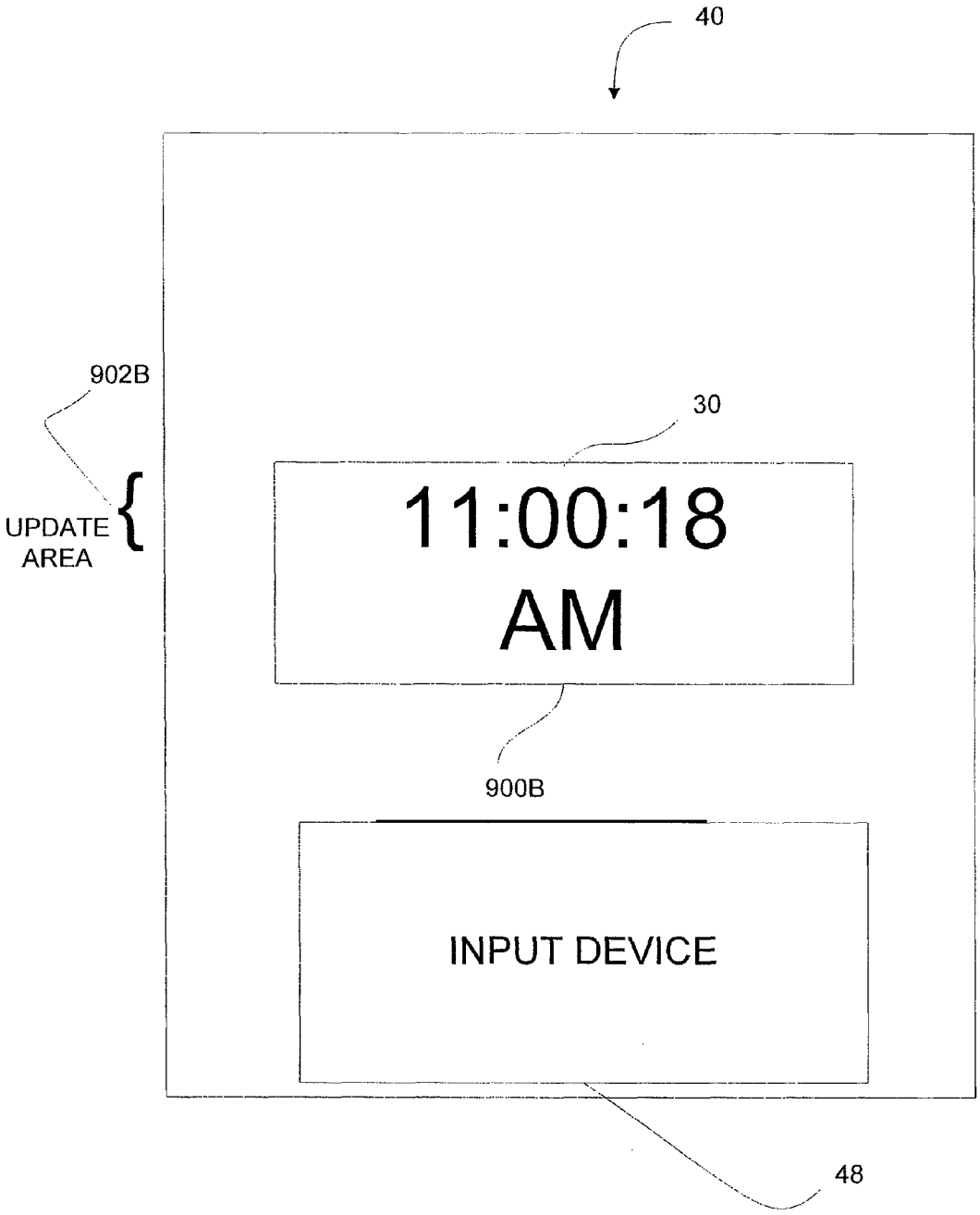

In certain embodiments, the time of day may be displayed in a limited segment of the pixels of display array 30. Referring now to FIG. 9B, exemplary display device 40 is shown with display array 30 and array driver 22 executing partial frame update display mode 814. In FIG. 9B, the clock is displayed with the AM/PM designation positioned below the Hours/Minutes/Seconds on the display. As each second passes and those rows displaying the second must be updated, while the AM/PM rows change only every twelve hours and do not require any update. Thus, updating the time of day does not require addressing each and every row in the display. Thus, when a partial frame update display mode indicator 814 is received by array driver 22, it acts only upon a limited portion of the received image data. In the example provided in FIG. 9B, only those rows in limited update area 902B will be addressed by array driver 22. The rows that display the AM/PM reading are not addressed or strobed.

Processor 21 and/or driver controller 29 may also be programmed to anticipate other display updates based on system events. For example, if the system detects a user input such as an input command to access a web browser, calendar, or some other type functionality that requires specific display content, processor 21 and/or driver controller 29 may, upon detecting the user input, implement total frame update mode 804 because the display data will be different from that currently presented on the display array 30. Or more specifically, because user inputs may have a known and/or predictable impact on the image data, the processor can communicate to the display controller or array driver when a partial or full display update is required.

In yet another embodiment, an "update and hold" mode may be defined to handle situations where the system will typically receive infrequent updates. The "update and hold" mode may be implemented in order to handle certain types of user input. From the point of view of the display, user inputs occur infrequently. For example, when using a cell phone, a user may wish to scroll through the stored address book to find information about a particular entry in the address book. In order to scroll through the list of entries, the user may actuate a button to move to the next entry in the list. Thus, in order to scroll through a list of many address book entries, a user repeatedly presses the "next entry" button on the phone. When a user scrolls though an address book on the phone in this manner, the screen will update infrequently from a display point of view. The user will scrolls through the address book at a pace that allows the user to see the data as it "moves" across the display. To account for these types of user inputs, an additional display mode may be defined in which array driver 22 will "update and hold" the display by updating display array 30 with a frame of data, but then not updating display array 30 with subsequent frames for a time interval defined at least in part by the typical speed of scrolling inputs received from a user.

In yet another embodiment, processor 21 and/or driver controller 29 may be configured to determine or set a display mode based on an input source. For example, display device 40 may comprise a "video phone" that displays video to a user. When the video phone is set to display video, constant updates of the display may be necessary at a given refresh rate. When the phone displays video, processor 21 and/or driver controller 29 may be configured to set a display mode by sending mode data with each video frame that instructs array driver 22 to act on all of the video data and to update the screen with each new frame.

In another embodiment, a conventional display apparatus may be modified so that it is compatible for use with both bi-stable and non-bi-stable display arrays. Many cell phones today are powered by chipsets which integrate several functions. These chipsets are often referred to as "systems on a chip" (SOC's). In one embodiment, driver controller 29, processor 21, and network interface 27 are contained in a single integrated chipset. Well known examples of integrated SOC's are the MSM® series of baseband chipsets by Qualcomm®. Although there have been efforts to standardize these devices, SOC's may be display-type specific because certain display types require certain display interfaces in order to effectively communicate with the system. For example, an LCD display may require a DVI interface. According to aspects of the invention described herein, an integrated SOC is provided with a display interface channel; that allows the chip to control a non-bi-stable display. The display interface channel for the SOC also includes additional electrical communication paths which carry mode indicator information to a bi-stable display, allowing a system built using the SOC and the mode indicator information to take advantage of power-saving features provided by the bi-stable display.

Figure 10A:
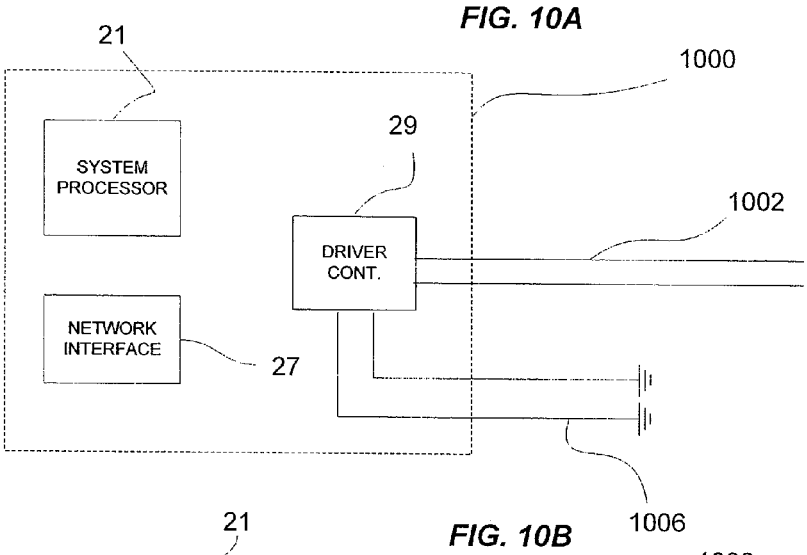
FIG. 10 illustrates various embodiments of a system on a chip.

Referring now to FIG. 10A, an integrated system on a chip (SOC) 1000 is provided in accordance with aspects of the present embodiment. SOC 1000 includes processor 22, network interface 27, and driver controller 28. SOC 1000 also includes data interface channels 1002 which may be used to carry display image data to a display module. In one embodiment, a display module may include display array 30 and array driver 22. In other embodiments, the display module may include additional components, or it may include only array driver 22, or only display array 30.

SOC 1000 may also include additional or different circuits, chips, and functionality beyond that which is described herein. Data interface channels 1002 may comprise a parallel interface or they may comprise a serial interface. In one embodiment, interface channels 1002 comprise a parallel interface, but one of skill in the art would readily appreciate that data interface channels 1002 might be implemented as a serial interface. SOC further includes mode information channels 1006, which, when operably coupled to a display module, may be used to carry mode information to the display module.

Figure 10B:
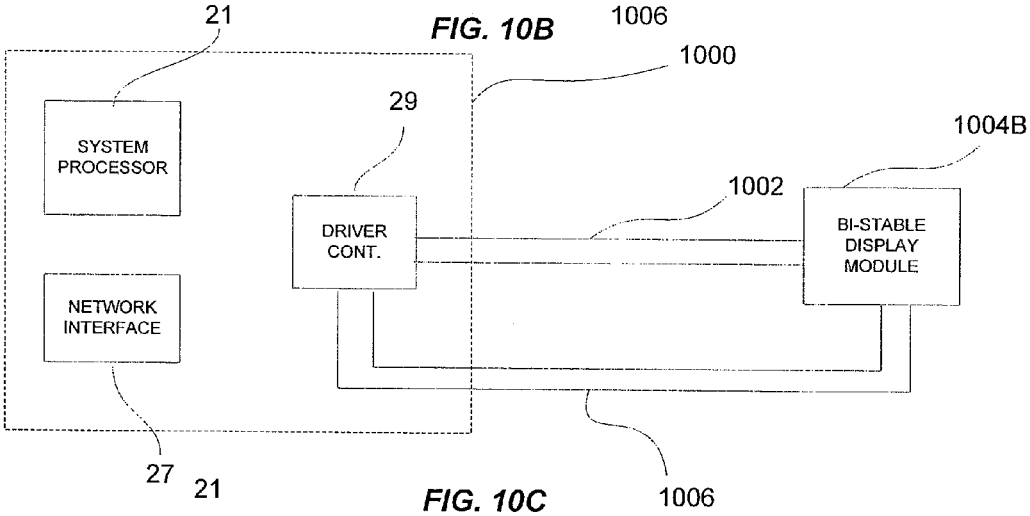

Referring now to FIG. 10B, integrated SOC 1000 is shown operably coupled to a bi-stable display module 1004B. The connection between SOC 1000 and bi-stable display module 1004B via data interface channels 1002 may be direct or indirect, so long as the image data is carried from SOC 1000 to bi-stable display module 1004B. Data interface channels 1002 are operably coupled to bi-stable display module 1004B and may carry processed display image data from SOC 1000 to bi-stable display module 1004B. Mode information interface channels 1006 are also operably coupled to bi-stable display module 1004B mode information and carry display mode information to the display. As discussed previously, display module 1004B may use the mode information to determine whether to act on the image data received over via data interface channel 1002.

Figure 10C:
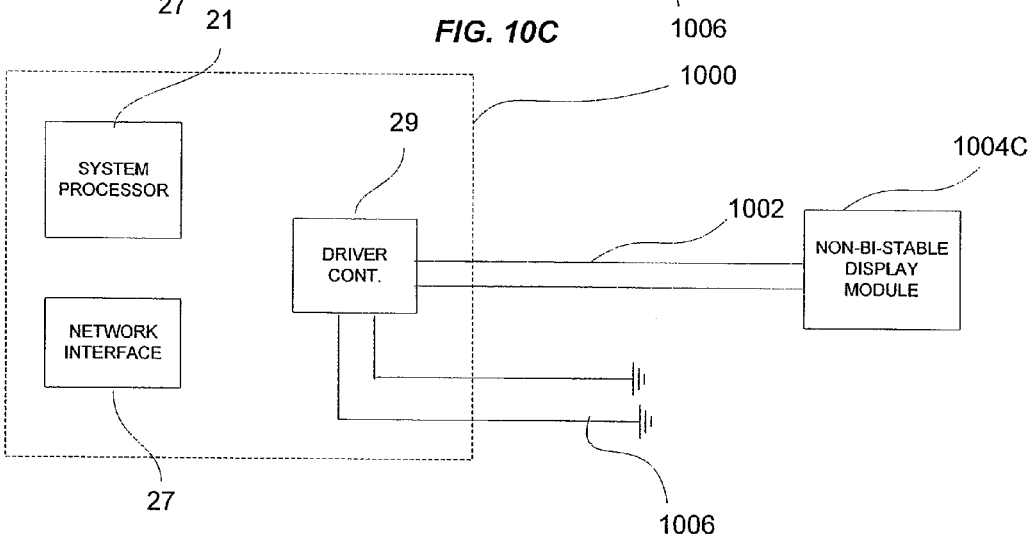

Referring now to FIG. 10C, integrated SOC 1000 is now shown operably coupled to non-bi-stable display module 1004C. Non-bi-stable display module 1004C may be a flat-panel display, such as plasma, EL, OLED, STN LCD, or TFT LCD as described above, or a non-flat-panel display, such as a CRT or other tube device or some other non-bi-stable display that is known in the art. Data interface channels 1002 are operably coupled to non-bi-stable display module 1004C and may carry processed display image data from SOC 1000 to non-bi-stable display module 1004C. However, unlike the configuration described in FIG. 10B above, the case of the non-bi-stable display, mode information interface channels 1006 are not operably coupled to display module 1004C. This is because the non-bi-stable display is not equipped to receive or handle the display mode information sent over the mode information interface channel 1006. In the particular embodiment shown, wires that comprise mode information interface channel 1006 may be grounded, resisted or floated.

Thus, the SOC 1000 may be used with either a non-bi-stable display or a bi-stable array merely by a modification of the connection of the SOC 1000 to the display module. The underlying chipset need not be modified. Such a configuration may be advantageous because a single chipset can be manufactured which can be used with multiple types of display interfaces (e.g., bi-stable displays and non-bi-stable displays), and in particular can effectively take advantage of the power-saving features of a bi-stable display.

Figure 11:
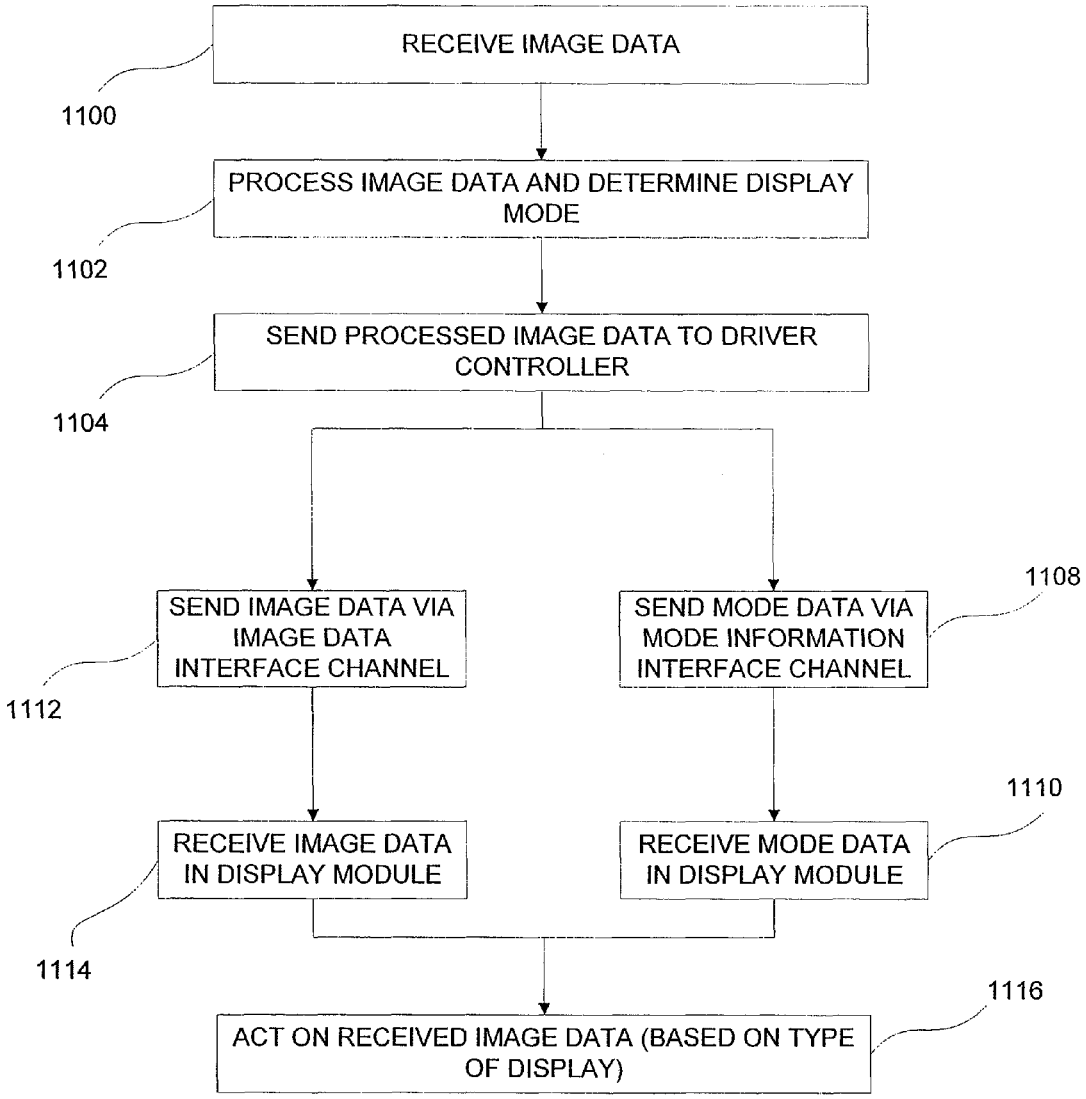
FIG. 11 is a flowchart illustrating a method for operating the system on a chip of FIG. 11.

Referring now to FIG. 11, a flowchart is provided that describes how data may be handled by SOC 1000 in an embodiment similar to the configuration described in FIGS. 10A-C. Because SOC may be configured to handle both non-bi-stable and bi-stable display modules, the data flow described in FIG. 11 is capable of handling each configuration provided in FIGS. 10B and 10C. Depending on the embodiment, additional steps may added, others removed, or the existing steps may be rearranged without departing from the scope of the claims.

At state 1100, image data is received into the SOC via any one of several image data sources such as a network interface, a user input device, or some other image data source. Continuing to state 1102, SOC processes the image data and determines a display mode for the received information. Typically, the image data will be processed by system processor 21, but in some embodiments, other processing components such as driver controller 29 may process the image data. At state 1104, the processed image data is sent to driver controller 29 (assuming that driver controller 29 had not already received and processed the image data). Driver controller 29 then sends the data in parallel down each path defined below state 1104. Thus, display mode data is sent over the mode information interface channel 1006 to the display module at step 1108, and at substantially the same time, the image data is sent to the display module via image data interface channel 1002 at step 1110. At steps 1112 and 1114, the display module receives the image data sent via data interface channel 1002 and mode information interface channel 1006, respectively. Continuing to step 1116, the display module acts on the received data. Depending upon the type of display, the display module may act differently on the received data. For example, if the display module includes a bi-stable display array, it may ignore the image data and simply maintain the current display, unless the mode data indicates that there is new data to display. Alternatively, if the display module includes a non-bi-stable display, it would ignore the mode information and act only on the image data received by the display.

Figure 12A:
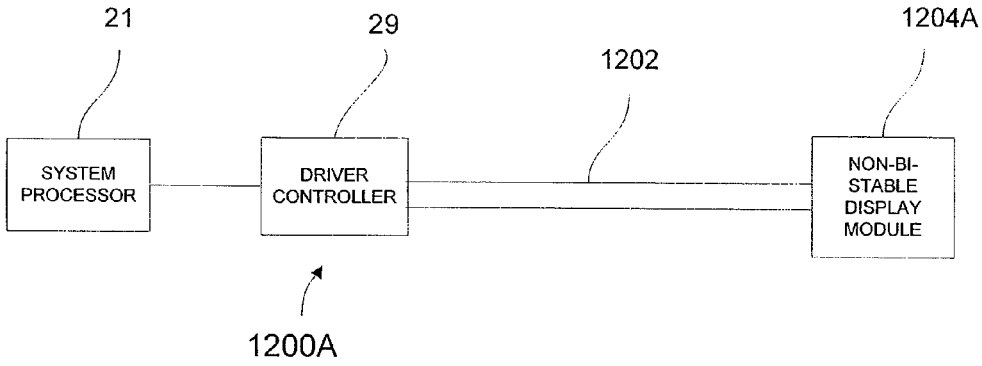
FIG. 12A (PRIOR ART)
FIG. 12 provides an example of a driver controller adapted for communicating with a bi-stable display via mode data interface channels.
Figure 12B:
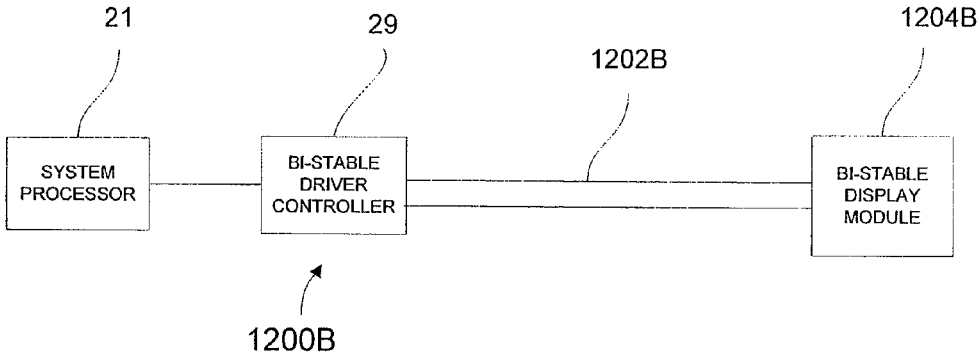
FIG. 12B (PRIOR ART)

Known display systems typically include components that are designed to specifically work with the specific display type included in the system. For example, in a non-bi-stable display apparatus, the driver controller is specific to non-bi-stable displays, and typically cannot be operably connected to bi-stable displays. Referring to FIG. 12A a known display apparatus 1200A is provided. Known display apparatus 1200A includes system processor 21 coupled to non-bi-stable display driver controller 29 which sends formatted image data to non-bi-stable module 1204A via an interface channel 1202A. FIG. 12B illustrates another known configuration that includes the use of a bi-stable display module 1204B. In this configuration, the system processor 21 is in electrical communication with a bi-stable display driver controller 29. The bi-stable driver controller sends formatted image data to bi-stable display module 1204B via an interface channel 1202B. Thus, in this configuration, the driver controller is specifically designed to work with the bi-stable display module.

Figure 12C:
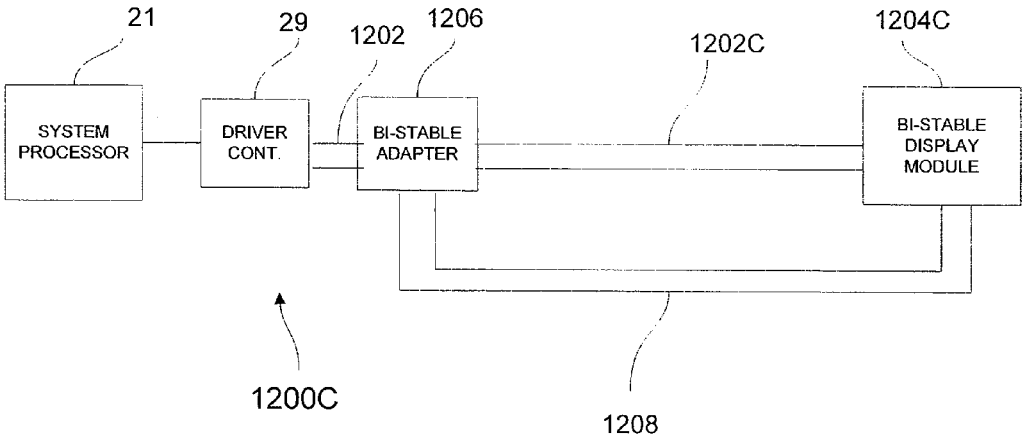

With reference to FIG. 12C, a display apparatus 1200C is provided in which an adapter may be provided to adapt a non-bi-stable driver controller for use with a bi-stable display. One of skill in the art would readily appreciate that such a configuration may be advantageous because it would allow manufacturers that provide both types of displays to limit their driver controller purchases to a single type of driver controller.

Display apparatus 1200C includes system processor 21 which receives image data and sends it to driver controller 29 which may be a conventional driver controller that can be coupled to a non-bi-stable display module. Driver controller 29 includes an interface channel 1202. Rather than being connected to display module as shown in FIG. 12A, interface channel 1202 is coupled to bi-stable adapter 1206 which in turn is coupled to bi-stable display module 1204C via a second data interface channel 1202C and a display mode interface channel 1208. Bi-stable adapter 1206 receives processed image data from driver controller 29, and determines a display mode for the data. Bi-stable adapter 1206 sends the image data via second data interface channel 1202B and mode data via mode interface channel 1208 to bi-stable display module 1204C. Thus, through the addition of bi-stable adapter 1206, conventional display components may be used with a non-bi-stable display module 1204C.

Figure 12D:
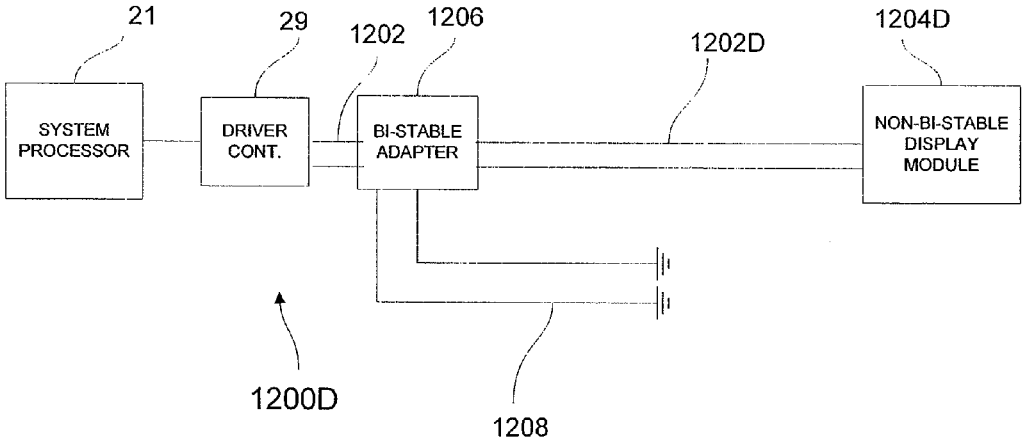

In yet another embodiment, the bi-stable adapter 1206 may be used in combination with a traditional non-bi-stable display module configuration. With reference to FIG. 12D, a didsplay apparatus 1200D includes a system processor 21. The system processor 21 may be configuered to receive image data and send it to driver controller 29 which may be a conventional driver controller that can be coupled to a non-bi-stable display module 1204D. However, instead of coupling driver controller 29 directly to the non-bi-stable display as shown in FIG. 12A, bi-stable adapter 1206, interface channel 1202 is coupled to bi-stable adapter 1206 which in turn is coupled to non-bi-stable display module 1204D via a second data interface channel 1202C. Because the non-bi-stable display module 1204D does not use the mode information carried on the display mode interface channel 1208, those interface channels may be grounded, resisted or floated.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. A display device comprising:

a processor configured to:

receive image data for display on a display that is operable in a plurality of modes, wherein the plurality of modes comprises at least two of the following modes:

a display data unchanged mode, a charge balance update necessary mode, a low power mode, a partial frame update mode, and an error mode;

receive mode data indicative of one of the plurality of modes; and control display of the image data on the display in accordance with the mode data.

2. The display device of claim 1, wherein the processor is configured to receive the image data and the mode data serially over a serial bus.

3. The display device of claim 1, wherein the processor is configured to receive the image data and the mode data in parallel over a parallel bus.

4. The display device of claim 1, wherein the display data unchanged mode indicates the image data is unchanged from a previous frame, and controlling display of the image data on the display in accordance with the mode data includes not updating the display with the image data.

5. The display device of claim 1, wherein the image data comprises a frame of data and the mode data is associated with the frame of data.

6. The display device of claim 1, wherein the image data comprises a line of a frame of data and the mode data is associated with only the line of the frame of data.

7. The display device of claim 1, wherein the processor comprises an array driver.

8. The display device of claim 1, wherein the processor comprises a driver controller.

9. A display device comprising:

means for receiving image data for display on a display that is operable in a plurality of modes, wherein the plurality of modes comprises at least two of the following modes:

a display data unchanged mode, a charge balance update necessary mode, a low power mode, a partial frame update mode, and an error mode;

means for receiving mode data indicative of one of the plurality of modes; and means for controlling display of the image data on the display in accordance with the mode data.

10. The display device of claim 9, wherein the display data unchanged mode indicates the image data is unchanged from a previous frame, and that the means for controlling will not act on the image data.

11. The display device of claim 9, wherein the image data comprises a frame of data and the mode data is associated with the frame of data.

12. The display device of claim 9, wherein the image data comprises a line of a frame of data and the mode data is associated with only the line of the frame of data.

13. A method of operating a display, the method comprising:

receiving image data for display on a display that is operable in a plurality of modes, wherein the plurality of modes comprises at least two of the following modes: a display data unchanged mode, a charge balance update necessary mode, a low power mode, a partial frame update mode, and an error mode;

receiving mode data indicative of one of the plurality of modes; and controlling display of the image data on the display in accordance with the mode data.

14. The method of claim 13, further comprising receiving the image data and the mode data serially.

15. The method of claim 13, further comprising receiving the image data and the mode data in parallel.

16. The method of claim 13, wherein the display data unchanged mode indicates the image data is unchanged from a previous frame, and that the display will not be updated with the image data.

17. The method of claim 13, wherein the image data comprises a frame of data and the mode data is associated with the frame of data.

18. The method of claim 13, wherein the image data comprises a line of a frame of data and the mode data is associated with only the line of the frame of data.

* * * * *